US006695917B2

(12) United States Patent
Wright et al.

(10) Patent No.: US 6,695,917 B2
(45) Date of Patent: Feb. 24, 2004

(54) FLOW THROUGH FELT DISPENSER

(75) Inventors: Douglas A. Wright, North Royalton, OH (US); Julius J. Molnar, Amherst, OH (US)

(73) Assignee: Nordson Corporation, Westlake, OH (US)

( * ) Notice: Subject to any disclaimer, the term of this patent is extended or adjusted under 35 U.S.C. 154(b) by 13 days.

(21) Appl. No.: 09/992,920

(22) Filed: Nov. 14, 2001

(65) Prior Publication Data

US 2003/0089310 A1 May 15, 2003

(51) Int. Cl.[7] ..... B05C 1/02

(52) U.S. Cl. ..... 118/257; 118/268; 15/97.1; 15/102

(58) Field of Search ..... 118/106, 257, 118/268, 70; 15/97.1, 102, 103; 427/429

(56) References Cited

U.S. PATENT DOCUMENTS 4,182,263 A * 1/1980 Naeser et al. ..... 118/60
4,622,241 A * 11/1986 Keys ..... 427/117
5,277,927 A 1/1994 Burns et al. ..... 427/8
5,370,905 A 12/1994 Varga et al. ..... 427/168
6,228,168 B1 * 5/2001 Johnson ..... 118/264
6,471,774 B1 * 10/2002 Krueger ..... 118/264

FOREIGN PATENT DOCUMENTS

WO WO99/59739 * 11/1999

* cited by examiner

*Primary Examiner*—Laura Edwards
(74) *Attorney, Agent, or Firm*—Calfee, Halter and Griswold, LLP

(57) ABSTRACT

A flow through felt liquid dispensing apparatus for applying liquids to a receiving surface. The dispensing apparatus may include one or more dispensing heads each including a dispensing gun and an articulated rub block. The articulated rub block includes a recess or galley just behind the felt so as to provide a puddle of liquid material for soaking through the felt during a dispensing operation. The apparatus may be tilted so as to present only one dispensing head at a time to the receiving surface. The galley has a geometry to improve the bead profile of the liquid material dispensed onto the surface. Liquid material is dispensed by relative lateral movement between the apparatus and the receiving surface.

33 Claims, 14 Drawing Sheets

FLOW THROUGH FELT DISPENSER

TECHNICAL FIELD OF THE INVENTION

The invention relates generally to apparatus and methods for dispensing fluids onto a surface using a felt applicator. More particularly, the invention relates to a flow through felt dispenser that utilizes one or more dispensing heads and additional features to provide a more uniform and consistent bead or film to the surface.

BACKGROUND OF THE INVENTION

Many industries utilize dispensing systems to apply liquid material to a surface. In the motor vehicle industry, for example, liquid primers are applied to a perimeter region of a windshield as part of the process for installing a windshield in a vehicle body. These primers may be of various types and are preparatory to applying a urethane bead to the windshield that bonds the windshield to the frame. In a typical process, the windshield manufacturer applies a roughened black ceramic frit to a marginal or perimeter region of the windshield on the side of the glass that is bonded to the frame. Before the urethane bonding material can be applied to the frit, a first type of primer must be applied to the surface of the frit with a rubbing action. Often this first type primer is clear in color and is a surface activator that quickly evaporates and prepares the frit surface for application of a second type primer. In order to be effective, however, the clear primer cannot be simply applied but must be applied with a rubbing action as well.

After the clear primer is applied, a second type primer is applied to the frit, again with a rubbing action. Typically the second primer is black in color. The black primer improves adhesion of the urethane to the frit, but more importantly functions to block ultraviolet radiation that would otherwise cause degradation of the urethane. The black primer tends to have a higher viscosity than the clear primer, with the latter having a viscosity about that of water. A typical black primer may have a viscosity, for example, of about 40–100 centipoise.

The primers may be applied to the windshield by manual operations, but more commonly they are applied by dispensing the primer onto the frit using a liquid dispensing gun, and then applying a rubbing action by robotically moving a piece of felt across the frit by relative movement between the windshield and the gun. In a known process commonly referred to as "drip and drag", the primer is applied onto the frit just ahead of the felt. The primer may be intermittently applied rather than continuously. When the type of the primer is changed, the felt must be changed or an opposite surface of the same felt piece used.

One such system utilizing a drip and drag process is disclosed in U.S. Pat. Nos. 5,277,927 and 5,370,905 which are owned by the assignee of the present invention, the entire disclosures of which are fully incorporated herein by reference. These patents provide a more detailed description of such apparatus and the various technical issues involved with applying these primers to a windshield.

Although the above referenced systems are a significant advance in the art, they as well as other known systems have limitations. For example, the known systems require manual changeover of the felt piece either for each type primer change or after each windshield is completed. This results in a substantial consumption of the felt material. The process of applying the primers to the frit tends to cause splashing of the primer onto surfaces that should not have primer. Still further, most vehicle windshields are not flat panes of glass but rather are curved, some more than others, particularly near the marginal area or perimeter. This can cause a loss of or diminished contact between the felt applicator and the frit, especially as the robotic arm passes around corners. Another drawback to a drip and drag process is an uneven bead profile, particularly of the more viscous black primer. The felt tends to push the primer ahead of it, thereby diverting primer to either side resulting in a "railroad track" profile in which the edges of the bead are thicker than the center region of the bead. Additionally, since the primers are applied by pulsing a dispensing gun on and off, it is difficult to control the amount of liquid material applied to the frit.

The need exists therefore to provide a process and apparatus for applying liquid material to a surface with a rubbing contact or action that overcomes or diminishes the aforementioned limitations of known systems.

SUMMARY OF THE INVENTION

The invention contemplates in one embodiment a liquid dispensing system that utilizes a flow through application process. In accordance with one aspect of the invention, the dispensing system uses two dispensing heads. Each head may dispense a liquid material that is of a different type (for example, possibly a different color or viscosity) than the other dispensing head. Each dispensing head may be presented to a surface, such as a windshield, and placed in contact with the surface, with the other dispensing head out of contact with the surface. The dispensing heads may be disposed side by side on a frame such that by applying a slight tilt or rotation of the frame only one dispensing head at a time contacts the surface.

In accordance with another aspect of the invention, each dispensing head utilizes a flow through process for applying liquid material to the surface. In one embodiment, a flow through process is realized by the use of a porous material, such as a felt web, that is held in position on each dispensing head. Each dispensing head includes a valve that controls flow of liquid material to the porous material. A rub block supports a portion of the porous material proximate to an outlet orifice of the valve. In accordance with another aspect of the invention, the rub block is configured to permit the block to be compliant or adjustable about at least one axis to improve contact between the porous material and an irregular surface. In one embodiment, the valve includes a ball nozzle and the rub block is installed on the ball so as to be able to pivot or swivel as the dispensing head traverses the surface. In accordance with another aspect of the invention, the rub block may further include a recess, pocket or galley between the valve orifice and the porous material to improve the bead profile of the liquid material applied to the surface.

In accordance with another aspect of the invention, a flow through liquid dispensing system is provided with an improved bead profile. The improved bead profile is achieved by use of the rub block galley design, as well as use of a pressure regulator, nozzle orifice size and a flow meter as a system or arrangement for controlling the amount of liquid material dispensed through the nozzle. Accurate volume and pressure control of the liquid material can thus be achieved during a dispensing operation rather than relying on triggering properties of the dispensing valve. The improved bead profile is more consistently produced and includes a greater volume of material near the center of the bead and less volume along the edges of the bead.

Various aspects of the present invention may also be used in a single dispensing head configuration.

These and other aspects and advantages of the present invention will be readily appreciated and understood from the following detailed description of the invention in view of the accompanying drawings.

DETAILED DESCRIPTION OF THE INVENTION

Figure 1:
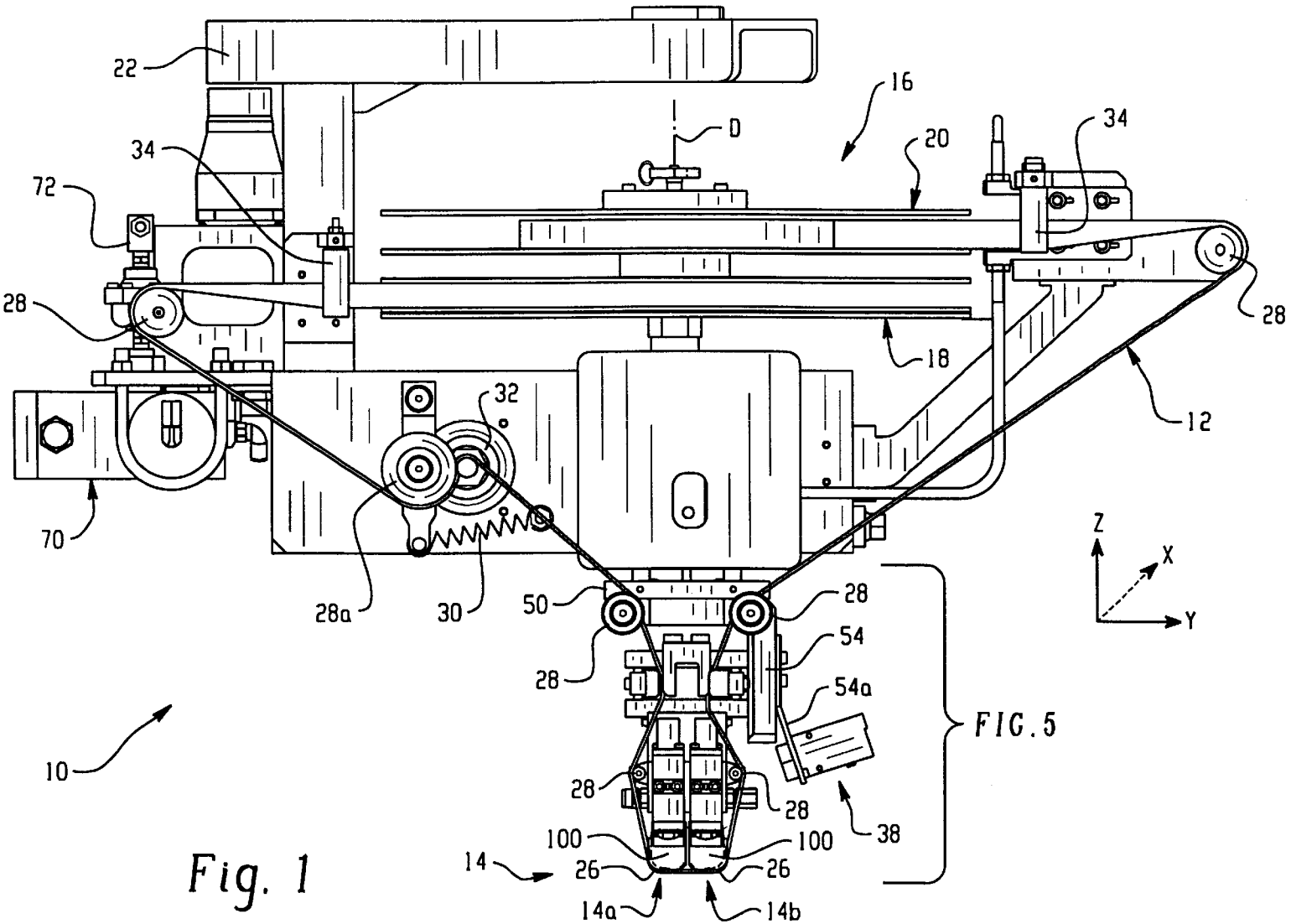
FIG. 1 is an elevation of a liquid dispensing apparatus in accordance with the invention.
Figure 2:
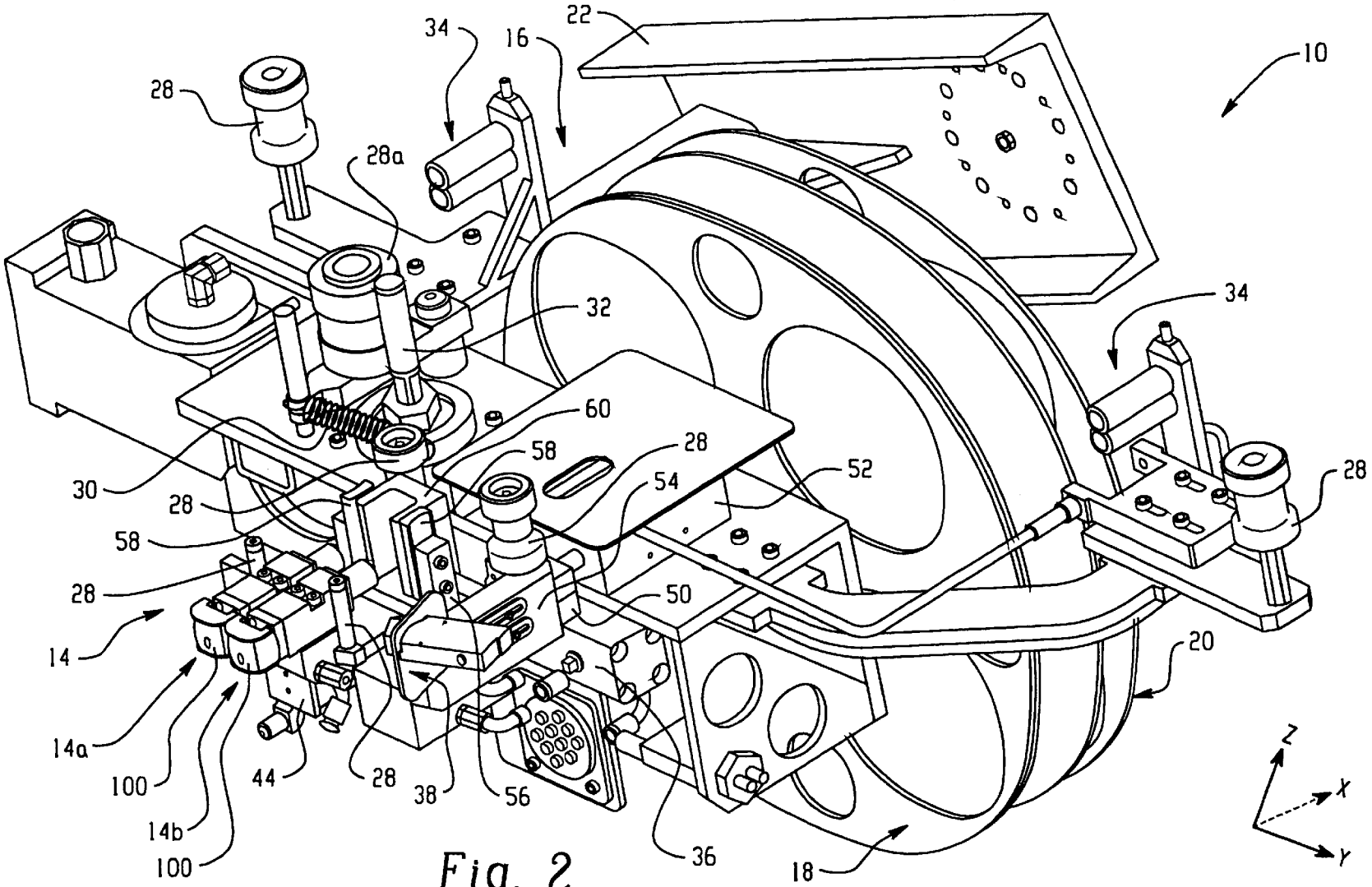
FIG. 2 is a perspective view of the apparatus of FIG. 1 viewed from below the apparatus and with the porous material web omitted.

With reference to FIGS. 1 and 2, the numeral 10 generally indicates a flow through liquid dispensing apparatus in accordance with and that embodies various aspects of the present invention. While the invention is described with particular reference to the application of two types of primers such as, for example, clear and black primers to a receiving surface such as a vehicle windshield, such description is intended to be exemplary in nature and should not be construed in a limiting sense. Those in the art will readily appreciate and understand that the invention may be used in other liquid dispensing applications including but not limited to the application of other types of primers or liquids to different types of receiving surfaces or substrates. It is noted that primers may be of different types though not necessarily different in color. Additionally, various aspects of the invention are described herein and are embodied in the exemplary embodiments. These various aspects however may be realized in alternative embodiments either alone or in various combinations thereof. Some of these alternative embodiments will be described herein but such descriptions are not intended to be a complete or exhaustive list of available alternative embodiments. Those skilled in the art may readily adopt one or more of the aspects of the invention into additional embodiments within the scope of the present invention even if such embodiments are not expressly disclosed herein. Additionally, even though some features may be described herein as being a preferred arrangement or method, such description is not intended to suggest that such feature is required or necessary unless so expressly stated.

A. General Description

With continued reference to FIGS. 1 and 2, the liquid dispensing apparatus 10 includes three basic sections, namely a porous material 12, at least one dispensing head section 14 and a supply mechanism 16 for feeding an unused portion of the porous material 12 for a dispensing application. In the exemplary embodiment the porous material 12 is in the form of a continuous web, and the supply mechanism 16 includes a supply reel 18 and a take-up reel 20. This arrangement allows for an automatic advance or indexing of the web 12 prior to each dispensing operation or between a selectable number of dispensing operations. Alternatively, however, a piece of porous material 12 may be manually installed in the apparatus 10 as required and thus the supply mechanism 16 may be omitted. Use of the automatic supply feature however will typically improve throughput speed.

The exemplary embodiment utilizes a pair of dispensing heads 14*a*, 14*b* positioned side by side along a direction of travel "Y" of the apparatus 10. The dual head configuration is used in this case for a typical windshield application of a clear and black primer. The dual head arrangement thus substantially reduces the amount of porous material used during a dispensing operation since the porous material needs to only be advanced or indexed one time for each complete application of a clear and black primer. Single heads may be used for applications requiring only a single liquid application for example.

On the drawings, the XYZ axes are provided as a frame of reference with the Z axis being the vertical axis along which the dispensing section 14 is positioned with pressure against the receiving surface S of the windshield. Pressure and position controls (not shown) may be used to maintain pressure between the dispensing section 14 and the receiving surface S to assure that the primers are dispensed with a good rubbing action between the porous material 12 and the surface as is known. The Y axis represents the direction of relative movement between the dispensing section 14 and the surface of the windshield. In this embodiment the Y axis also corresponds to the direction that the porous material 12 is advanced. The X axis completes the frame of reference such that, as an example, a windshield or other surface onto which liquid material is dispensed would generally lie in the XY plane. Note that FIG. 2 illustrates the apparatus 10 in perspective by a slight clockwise rotation about the Y axis and the Z axis as compared to FIG. 1.

The dispensing apparatus 10 is moved relative to the windshield or receiving surface S by any suitable robotic or motion device. For example, the apparatus 10 may be mounted to a robot arm programmed to move the dispensing section 14 along the outer perimeter of a stationary windshield held in a jig or other suitable fixture. Alternatively the dispensing apparatus may be stationary and a robot or other platform used to move the windshield. Both could be moved if so desired. Whatever method is selected, liquid material is dispensed by contact pressure between the dispensing section 14 and the windshield by relative movement there between.

Figure 3A:
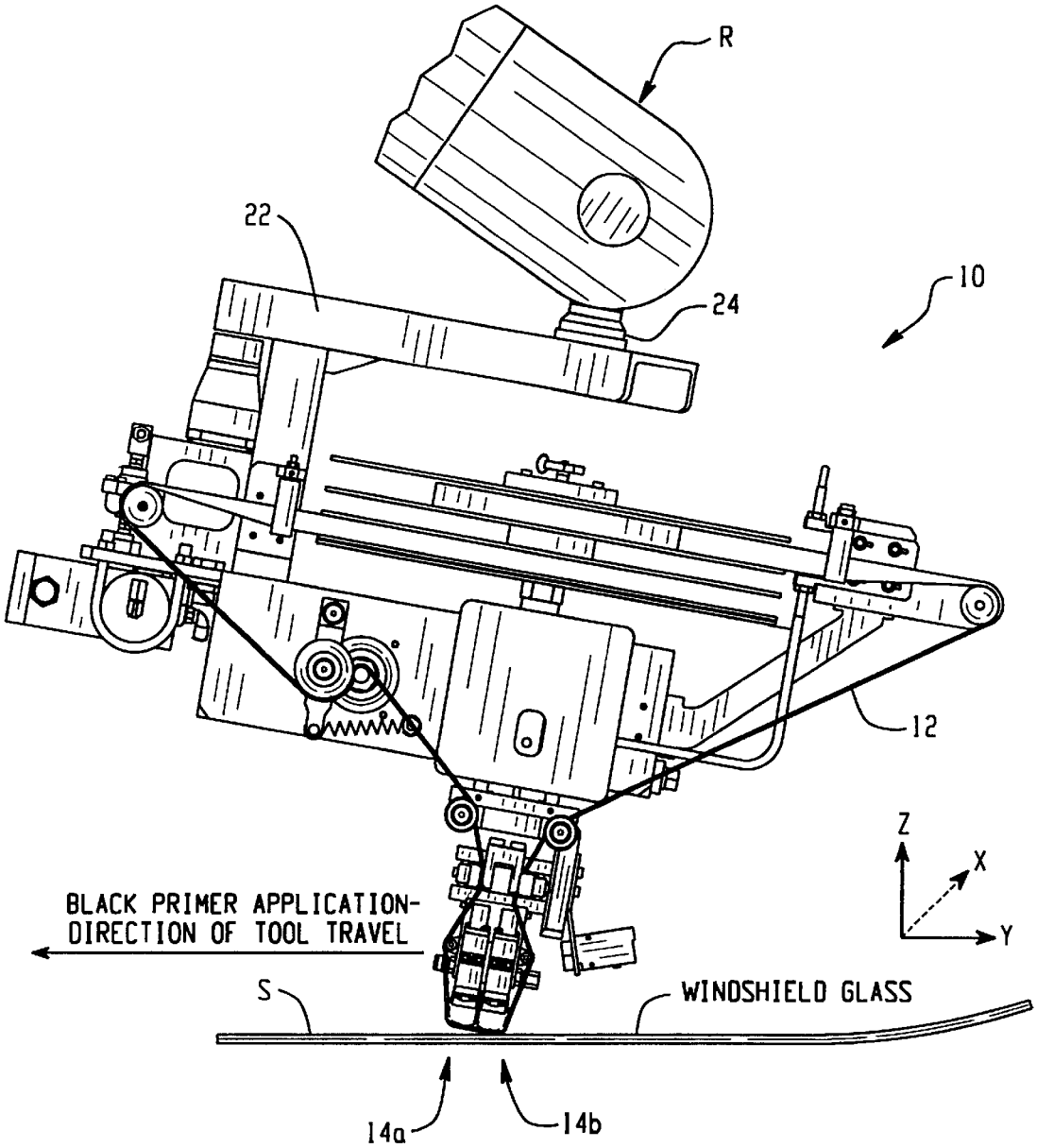
FIGS. 3A and 3B illustrate exemplary dispensing positions for each of the dual heads of FIG. 1.
Figure 3B:
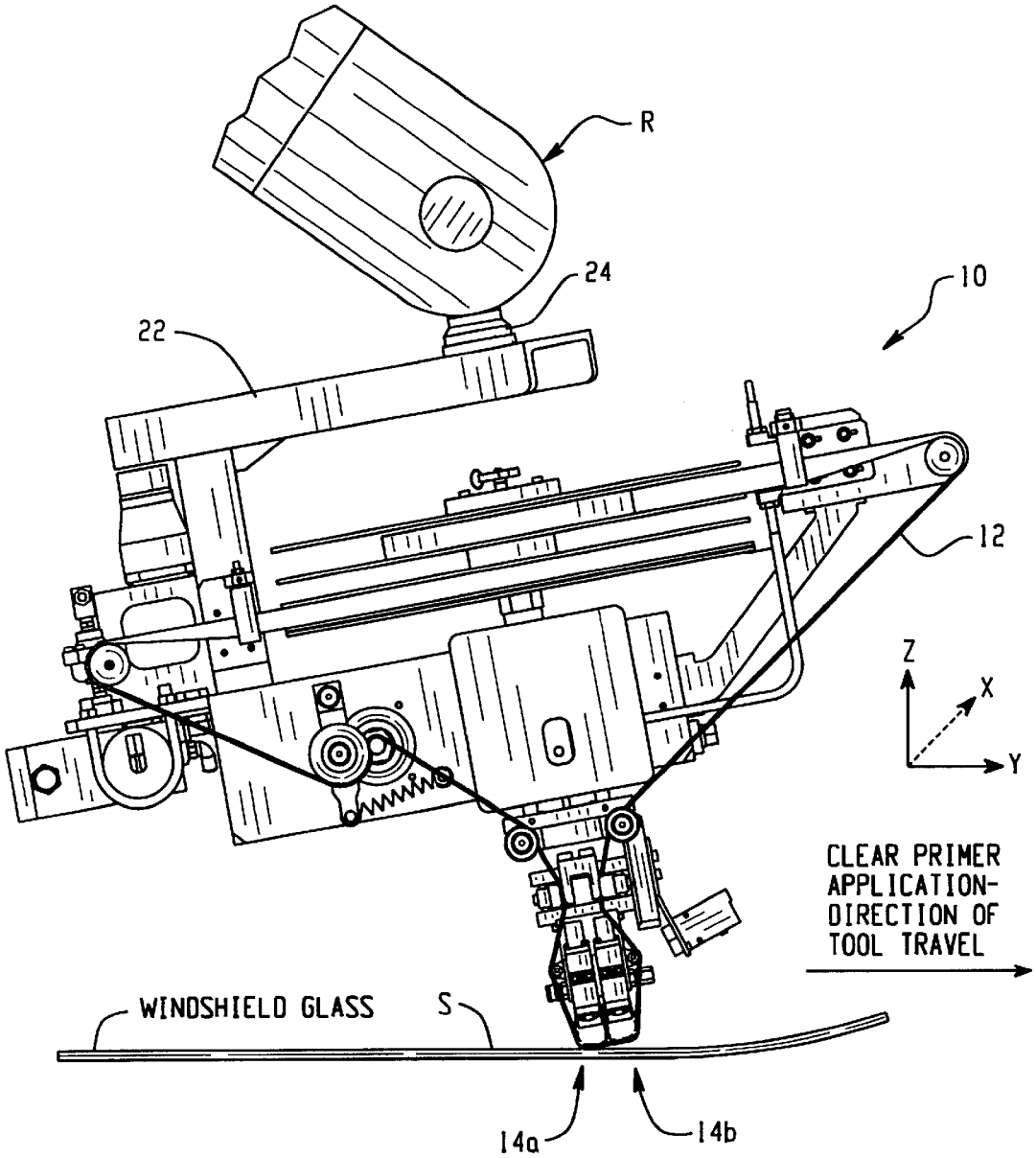

With reference to FIGS. 3A and 3B, the use of a dual head dispensing section 14 significantly speeds up a dispensing operation for clear and black primers to a windshield. As illustrated, the dispensing apparatus 10 includes a frame 22 having a suitable robot mounting interface arrangement 24 to mount the apparatus 10 onto the end of a robotic arm R. The robotic arm R not only moves the apparatus 10 along the perimeter of the windshield surface S, but also can pivot or rotate the apparatus 10 about the X axis and hold that position during a dispensing operation so that only one dispensing head 14*a,* 14*b* is in contact with and applying liquid material to the receiving surface S at any given time. Techniques other than tilting may be used to present only one dispensing head 14 at a time to the receiving surface S. For example, each head 14*a,* 14*b* may be raised or lowered independently along the Z-axis. Other techniques will be readily available as required, and in some applications it may not always be necessary to keep one of the heads 14 out of contact during dispensing operations.

In FIG. 3A the dispensing head 14*b* is in contact with the surface S and in FIG. 3B the dispensing head 14*a* is in contact with the surface S. The amount of pivoting movement about the X axis will be determined by the size of the dispensing heads 14*a,* 14*b* and the desired clearance between the non-contacting dispensing head and the surface S during the time that the other dispensing head is being used. We have found that a rotation of about 10° on either side of vertical (Z axis) provides adequate clearance, however, other pivot angles may be used as required. The clearance is desirable so that black primer does not collect on or cross-over to the clear primer dispensing head.

To further reduce cross-over of one primer type to the adjacent dispensing head, note that the direction of travel of the apparatus 10 is preferably selected so that the active dispensing head (14*b* in FIG. 3A and 14*a* in FIG. 3B) is the rearward or trailing head relative to the direction of travel. Thus the robotic arm R reverses the direction of travel when switching between dispensing heads 14*a,* 14*b*. By having the active head trailing the raised head, the liquid material is dispensed onto the surface S behind the raised dispensing head and cannot come into contact with the raised head.

Although the reverse travel feature and trailing dispensing head arrangement are preferred techniques, they are not required. The active dispensing head could be the leading or forward head. Separately or in combination therewith, the robot could be used to move the apparatus 10 in a single direction if so desired.

With reference again to FIGS. 1 and 2, the porous material 12 in this example is a continuous web or loop of material such as a thin web of felt. During each dispensing operation, however, only a small portion 26 of the felt 12 actually is in contact with the surface S. The contact portion 26 of the felt overlays a part of the dispensing head 14 called a rub block 100. As will be described more fully herein, the rub block 100 presses the felt against the surface S and provides a passageway for a pressurized flow of liquid material to soak the felt during a dispensing operation. For purposes of convenience then, each dispensing head section 14 is considered to include a small felt section 26 that is sandwiched between the corresponding rub block 100 and the receiving surface S because preferably, although not necessarily, only felt contacts the surface S during a dispensing operation.

Unused felt web 12 is stored on the supply reel 18 and used felt is recovered by winding it onto the take-up reel 20. To reduce the size of the apparatus 10, the reels 18, 20 are arranged horizontally and are stacked vertically one above the other on a common axis D. Alternatively, the reels 18, 20 may be supported side by side much like a reel to reel movie projector or tape player. Other mounting techniques may be use as required for a particular application as will be readily apparent to those skilled in the art.

A suitable number of tensioning rollers 28 are used to support and guide the felt web around the dispensing heads 14. In this example, at least one of the rollers 28*a* is spring biased by a tensioning spring 30 against a payout roller 32. In this embodiment, because the supply and take-up reels 18, 20 are vertically stacked and payout the web 12 in a plane that is transverse to the plane XY, the felt web 12 will include a 90° twist to properly overlay the rub blocks 100. Alignment rollers 34 may be used to prevent twist of the felt web 12 onto the reels 18, 20.

Controlled payout and movement of the felt web 12 may be realized with conventional pneumatic or other suitable drive mechanisms. A small pneumatic motor 36 may be used to oppositely turn the reels 18, 20 thus placing the web 12 under tension.

The payout roller 32 preferably has a non-slip surface that allows the roller 32 to advance the web 12 when the roller 32 is rotated. The payout roller 32 may be turned by any suitable drive mechanism such as a pneumatic motor. A typical payout for a new dispensing operation may be about two inches but will depend on the size of the dispensing head section 14 and how much liquid materials soaks into the web 12 in the vicinity of the dispensing heads 14. The felt web 12 is advanced a sufficient amount to assure that a completely new portion 26 of the web 12 is presented at the rub blocks 100 prior to a selected dispensing operation. Note that the felt web 12 is clamped in position relative to the rub blocks 100 during an actual dispensing operation. New or unused felt is advanced by the payout roller 32 before the next dispensing operation by unclamping or releasing the felt web 12. When a dual dispensing head configuration is used it is contemplated that one complete dispensing operation includes dispensing fluid from a first of the dispensing heads 14 and then the other. The side by side dispensing heads 14*a,* 14*b* thus minimize the amount of felt 12 used during a dispensing operation of applying two primers to the receiving surface S.

An optical sensor 38 may be used as part of the web payout control. The optical sensor 38 may be used to detect the presence of black primer on the "used" felt web, and provide a signal corresponding thereto to stop further payout of the felt. The sensor 38 preferably is positioned between the dispensing head section 14 and the take-up reel 20 but fairly close to the dispensing section 14 so as to minimize the amount of felt 12 payed out between dispensing operations. Note that preferably the felt web 12 is only advanced in a single direction across the rub blocks 100. Furthermore, because the felt web 12 physically contacts the rub blocks 100, each indexing or advancement of the web 12 produces a wiping action that helps clean the rub blocks between dispensing operations. This is particularly useful for the clear primer dispensing head which preferably is first to encounter a new or clean portion of the felt web 12. Thus in the exemplary embodiment for example, the clear primer dispensing head would be the left side head 14*a* (as viewed in FIG. 1).

B. Dispensing Head Section

Figure 4:
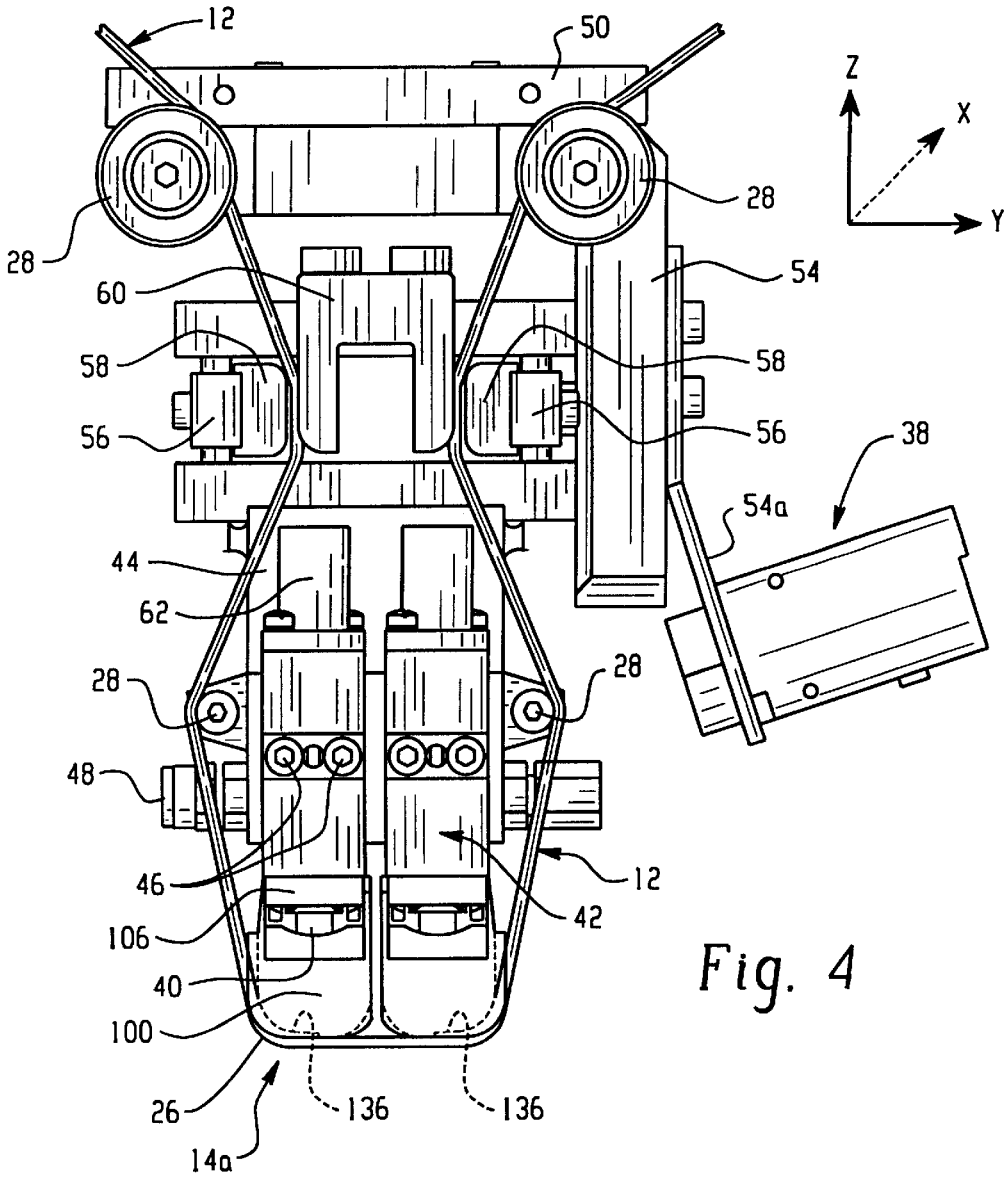
FIG. 4 is an enlarged elevation of a dispensing head section of the apparatus of FIG. 1.

With reference to FIG. 4, the dispensing head section 14 is illustrated in an enlarged view. In this embodiment there are two dispensing heads 14*a*, 14*b* that are substantially the same in design and operation, therefore, a detailed description of only one (14*a*) will be given herein.

The dispensing head 14*a* includes a rub block 100 that is installed on a dispensing nozzle 40. The nozzle 40 extends from a dispensing gun assembly 42. Each gun 42 may be, for example, model H200 available from Nordson Corporation of Westlake, Ohio. Any suitable dispensing mechanism may be used, however. The dispensing gun 42 is mounted to a manifold block 44 using bolts 46. A suitable primer supply fitting 48 provides a liquid material inlet to the gun 42.

The manifold 44 is mounted on a slide 50. The slide 50 may be raised or lowered by a suitable pneumatic actuator 52 (FIG. 2) as viewed in FIGS. 1 and 4 to position the dispensing head in contact with the receiving surface S. Conventional pressure and position controls may be used to maintain a fairly constant pressure of the rub block 100 and felt 26 against the surface S during a dispensing operation even for irregular surface contours. A mounting bracket 54*a* extends from a support bracket 54, which is mounted on the slide 50 and supports the optical sensor assembly 38 thereon.

Although the felt web 12 should have some slack or give to permit the dispensing head section 14 to adjust along the Z axis, it is desirable to maintain the felt portion 26 taut and snug against the rub block 100. Accordingly, a pair of clamping or gripper jaws 56 are provided. Each jaw 56 includes a gripper pad 58. An actuator (not shown) is used to move the jaws 56 to the position illustrated in FIGS. 1 and 4. In this position, the gripper pads 58 snugly hold the felt web 12 against a pinch block 60. The jaws 56 may be opened by lateral movement to release the clamping grip of the gripper pads 58 when it is desired to index or advance the felt web 12. Note from FIG. 4 that in addition to holding the felt web 12 in place during a dispensing operation, the grippers 58 also apply tension to the web 12 by somewhat tensioning the web against the lower rollers 28 that are adjacent the guns 42. The pinch block 60 may be moveable along the Y-axis to provide a self-centering function thereby compensating for material build-up on the used portions of the web 12. In this manner, the web 12 is held in proper alignment on the rub blocks 100 during a dispensing operation.

A valve actuator 62 such as a pneumatic actuator is provided as part of the dispensing gun assembly 42. In the exemplary embodiment each gun assembly 42 includes a needle valve that is opened and closed under control of the associated valve actuator 62. The manifold 44 provides an inlet for a pressurized air source used to operate the actuators 62.

A flow meter 70 may be used to monitor the flow volume of liquid material being dispensed. In one embodiment, the flow meter 70 generates a signal such as an alarm signal if during a dispensing operation the flow volume was too high or low. This signal may be detected by the control electronics or the operator and used either to reject the workpiece or to at least indicate a need for an inspection of the workpiece after a dispensing operation. A flow regulator 72 may be used in a conventional manner to regulate the liquid material pressure supplied to the dispensing guns 42. The pressure of the liquid material, in combination with the nozzle orifice size (112) will determine the flow rate of liquid material dispensed from the gun 42 into the felt web portion 26 and onto the receiving surface S.

It is also contemplated however that a more precise control of the flow volume of liquid material being dispensed be provided in some applications. In accordance with another aspect of the invention, flow volume of liquid material to the felt web 12 may be controlled by use of a flow meter feedback function in combination with the flow regulator 72 and orifice 112 size. By way of contrast, prior art systems typically control the quantity of liquid material dispensed onto the receiving surface S by pulsing the dispensing gun on and off at a selected rate. This prior art technique is not a particularly accurate way to control flow volumes. In accordance with another aspect of the invention, the flow meter 70 generates a signal that corresponds to flow rate, and this signal is used as part of a closed loop feedback control to adjust the flow regulator on a real-time or near real-time basis to assure that proper flow volume of liquid material is dispensed onto the receiving surface S. This technique has the added benefit that a pressurized puddle or reservoir of liquid material is produced at the portion of the felt web 26 that actually contacts the receiving surface S (the design of the rub block 100 facilitates this effect, as will be fully described herein after).

In either case, use of the pressure regulator 72 and the orifice 112 produces a smooth flow of liquid material that soaks through the felt web 12 for application to the receiving surface S, thereby improving the bead profile applied to the receiving surface. This is a significant improvement over controlling flow volumes merely by triggering the dispensing gun on and off at a selected rate.

All of the pneumatic and electrical control functions of the apparatus 10 may be executed using a conventional programmable microprocessor or micro-controller or other suitable control circuits as is well known to those skilled in the art. Pneumatic actuators and controls are not required as any suitable actuator design may be used.

C. Articulated Rub Block

Not all surfaces and substrates onto which liquid material is to be dispensed are flat or planar. For example, vehicle windshields usually have a curvature, particularly about the perimeter or marginal edge. A rigid non-compliant dispensing head is therefore difficult to maintain in good contact with the surface, such as when the dispensing head travels around corner regions. The result of poor contact is an inconsistent bead profile and possibly missed areas.

In accordance with another aspect of the invention, a dispensing head design is used that more readily conforms to the variable contour of a surface. Such a compliant dispensing head produces a more consistent bead profile.

In the exemplary embodiment, a compliant dispensing head 14 is realized in the form of an articulated rub block 100. By "articulated" is meant that the block 100 has some degree of freedom to pivot about at least one axis so as to be able to maintain alignment with the surface S, thus assuring good contact between the felt section 26 and the surface S. Because the rub block 100 moves relative to the surface S along the axis Y, in the preferred embodiment the block 100 is designed to pivot or roll about the Y axis about 10° either side of normal. The degree of permitted articulation will depend on the extent of curvature present in the surface S. The ability of the block 100 to roll allows for workpiece variation and robot programming errors which typically are not more than about ±10°. The present invention is not limited by any specific degree of articulated movement, but most applications will be about 20° or less either side of normal (normal being 0° referenced to the Z axis). Articulated or pivoting movement about the Z axis (yaw) or X axis (pitch) is not as beneficial and may in some applications be undesirable. If the rub block 100 pivots or yaws about the Z axis, the felt 12 will tend to be oriented on a line other than the Y axis direction of travel, possibly producing an inconsistent bead width or an incorrect orientation of the felt on the rub block 100. If the rub block 100 pivots or pitches about the X axis the felt web 12 might lose contact or have less pressure against the surface S. Since the apparatus 10 already compensates for Z axis variation, there is no need usually for the rub block 100 to be able to pitch about the X axis. In accordance then with this aspect of the invention, the rub block 100 is designed to articulate primarily about the Y or roll axis, and to be more restricted against pivoting about the X and Z axes.

Achieving a consistent bead pattern is also a function of controlling the flow of liquid material through the felt web 12 as a function of the travel speed of the dispensing head 14 across the surface S. In accordance with this aspect of the invention, the rub block 100 includes a galley or pocket or recess formed in a surface of the rub block 100 against which the felt web 12 is pressed. The galley provides a volume in which the pressurized liquid material collects or puddles adjacent the felt web 12. This pressurized puddle action improves the flow of the liquid material through the felt 12 onto the receiving surface S to produce a more consistent bead pattern.

Figure 5:
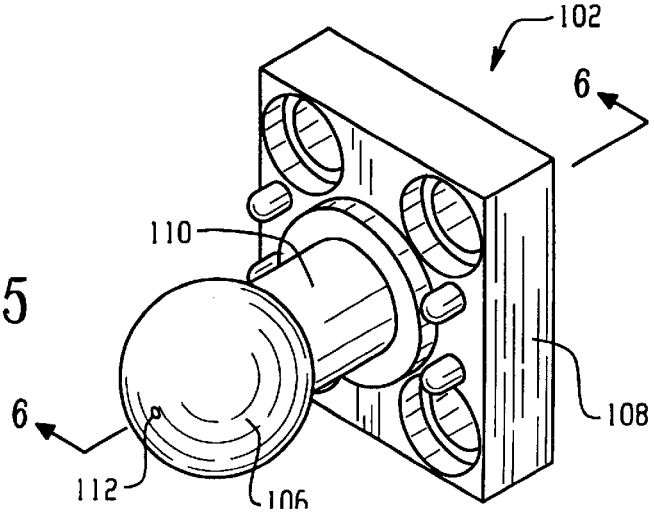
FIG. 5 is a nozzle in perspective.

Each dispensing head section 14*a,* 14*b* includes four basic components, a nozzle 102, a valve needle 124, the rub block 100 and the adjacent portion of the felt web 26. With reference to FIG. 5, in this embodiment, the nozzle 102 is a ball type nozzle 106 having a mounting block 108 that is installed by screws or bolts onto the dispensing gun 42. The ball nozzle 106 depends from the mounting block 108 on a valve stem shaft housing 110. An outlet orifice 112 is formed at the bottom of the ball nozzle 106. Preferably but not necessarily the nozzle 102 is a unitary piece such as made, for example, from a machined stainless steel or other suitable material.

Figure 6:
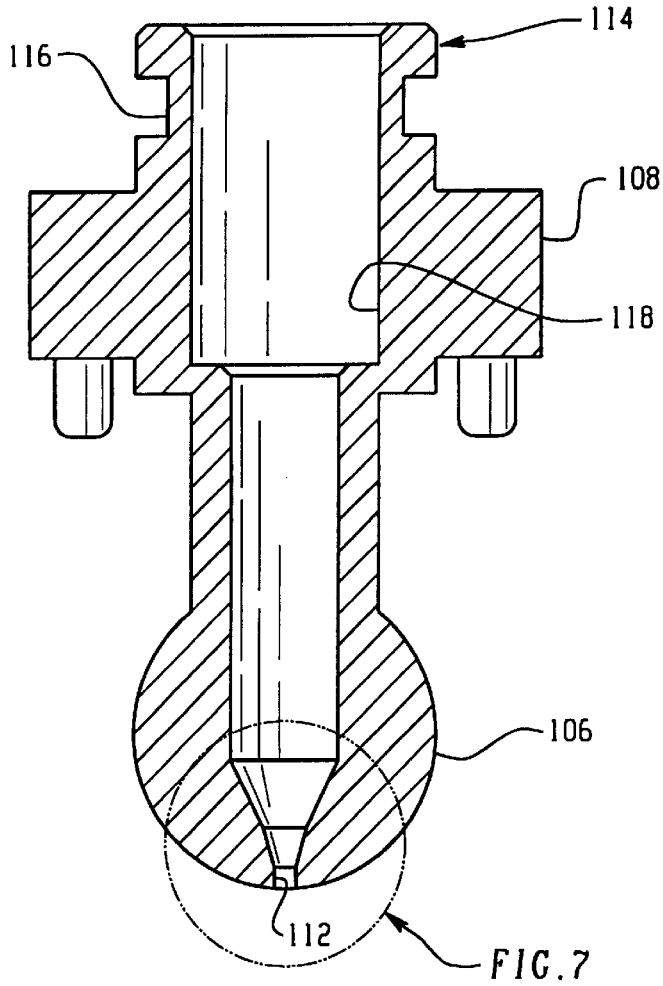
FIG. 6 is the nozzle of FIG. 5 in longitudinal section along the line 6—6 in FIG. 5.
Figure 7:
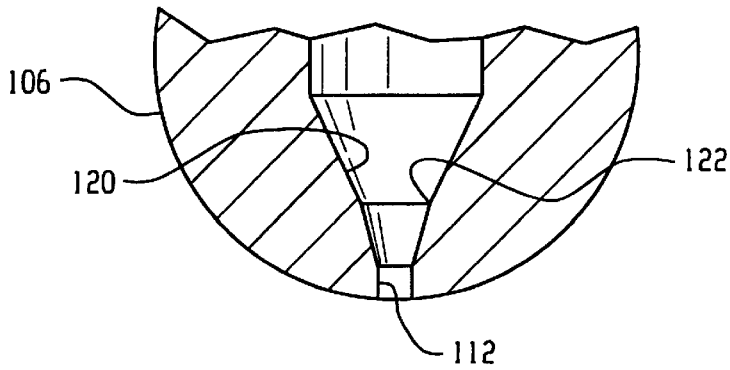
FIG. 7 is an enlarged view of a nozzle orifice denoted by the dotted circle in FIG. 6.

As best illustrated in FIG. 6, the mounting block 108 includes an upwardly extending nipple 114 having an o-ring or seal groove 116 formed therein. The nipple 114 is inserted into the lower end of the dispensing gun 42 such that liquid material is free to flow from the gun 42 into the material passageway 118 that extends through the nozzle 102 to the orifice 112. With reference to FIG. 7, the orifice 112 opens to an axially tapered passageway 120. The orifice 112 and the tapered passageway 120 join at a needle valve seat 122.

Figure 8:
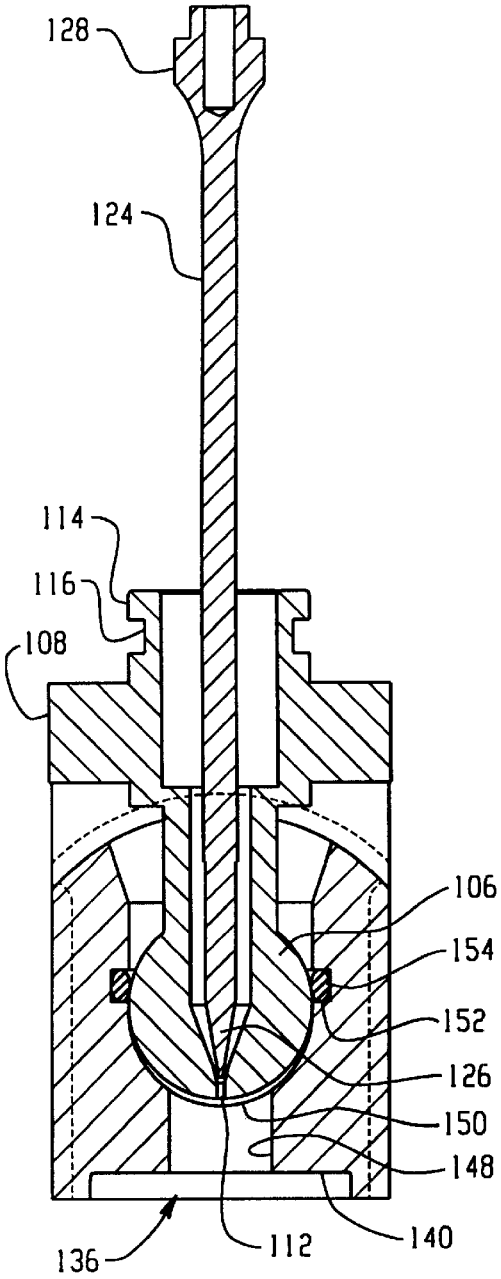
FIG. 8 is a nozzle and rub block assembly in vertical cross-section.

FIG. 8 illustrates a valve needle 124 installed in the nozzle 102. The valve needle 124 includes a tapered tip 126 that opens and closes the valve orifice 112 depending on the position of the needle 124. The valve needle is installed into the dispensing gun 42 and includes an end 128 that is connected with or operably joined to the valve actuator which controls movement of the valve needle 124 to open and close the valve.

Figure 8A:
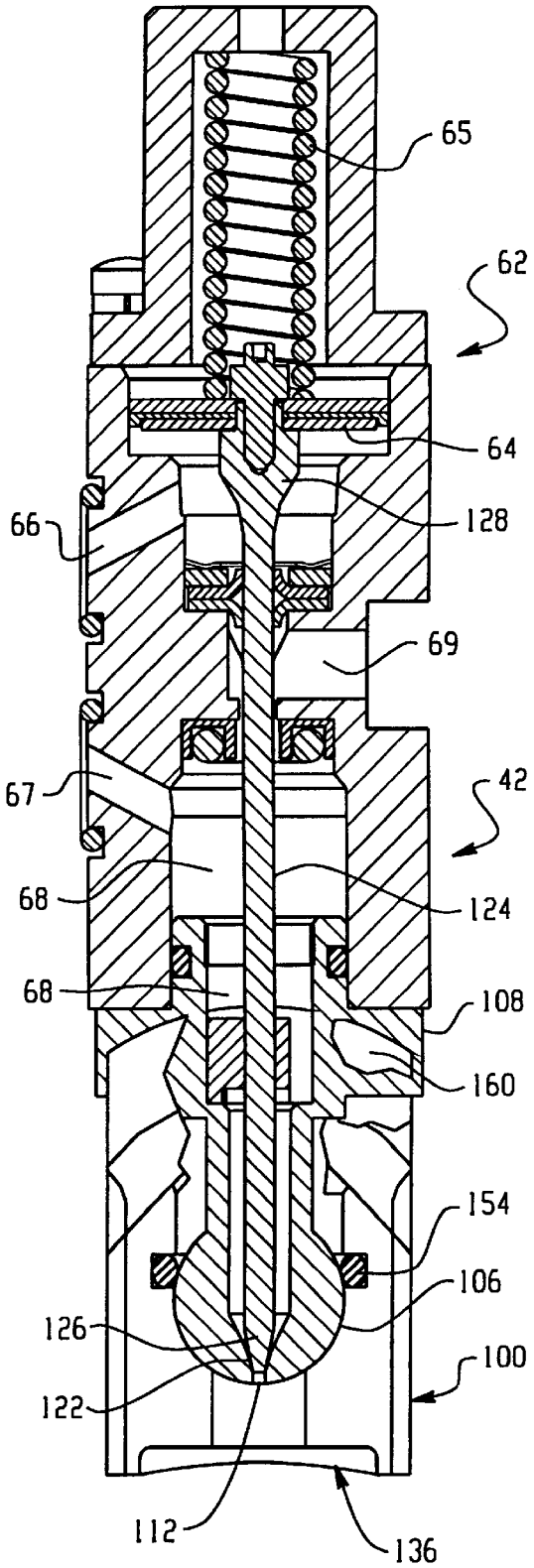
FIG. 8A is a rub block and nozzle/dispensing gun assembly in longitudinal cross-section.

FIG. 8A illustrates one embodiment of a complete rub block 100 and dispensing gun 42 assembly. The actuator 62 receives the upper end 128 of the valve stem 124 at an actuating piston or plate 64. A spring 65 biases the valve needle 124 to the closed position (illustrated in FIG. 8A). An air inlet port 66 is used to supply pressurized air that acts against the underside of the piston 64 and the force of the spring 65 to open the orifice 112 by pulling the tip 126 away from the valve seat 122. A liquid material inlet port is used to supply liquid material such as a primer to a flow passageway 68 within the dispensing gun 42. The liquid material flows through the passageway 68 around the stem 124 to the orifice 112. A weep hole 69 may be provided as required.

Figure 9:
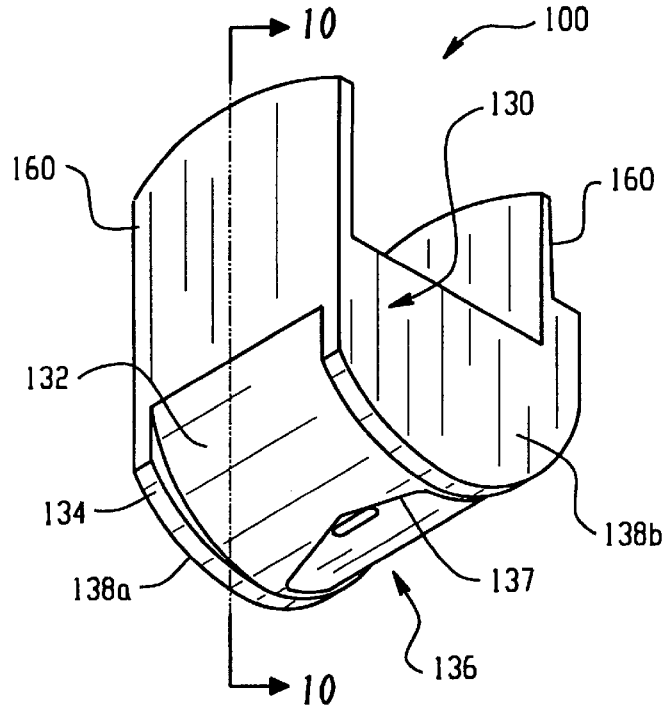
FIG. 9 is a lower view perspective of one embodiment of a rub block.
Figure 10:
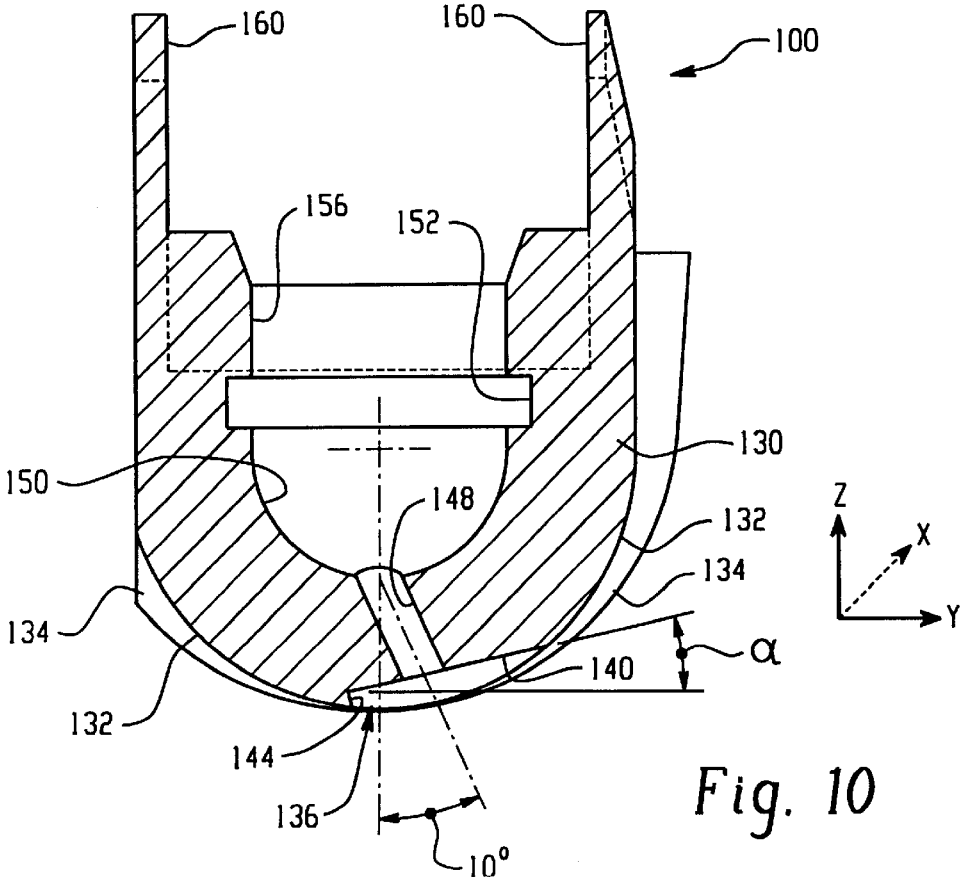
FIG. 10 is a longitudinal cross-section of the rub block of FIG. 9 taken along the line 10—10.

FIGS. 9 and 10 illustrate an underside perspective of one embodiment of a rub block 100. This embodiment may be used, for example, as the rub block 100 design for a dual dispensing head configuration such the embodiment of FIG. 1. The rub block 100 is a hood-like structure having a main body 130 that is generally U-shaped. The body 130 has an outer rounded surface 132 against which the felt web 12 is positioned and traverses when new felt is advanced by the supply mechanism 16. The outer surface 132 supports the contact portion 26 of the felt web 12 so that the felt web 12 can be pressed against the receiving surface S during a dispensing operation.

A tapered wall or fence 134 on each side of the felt supporting surface 132 helps maintain the felt web 12 in proper position on the rub block 100, particularly when the felt is advanced prior to a dispensing operation, and also to help hold the felt web 12 in proper position on the rounded supporting surface 132 during a dispensing operation.

Figure 11:
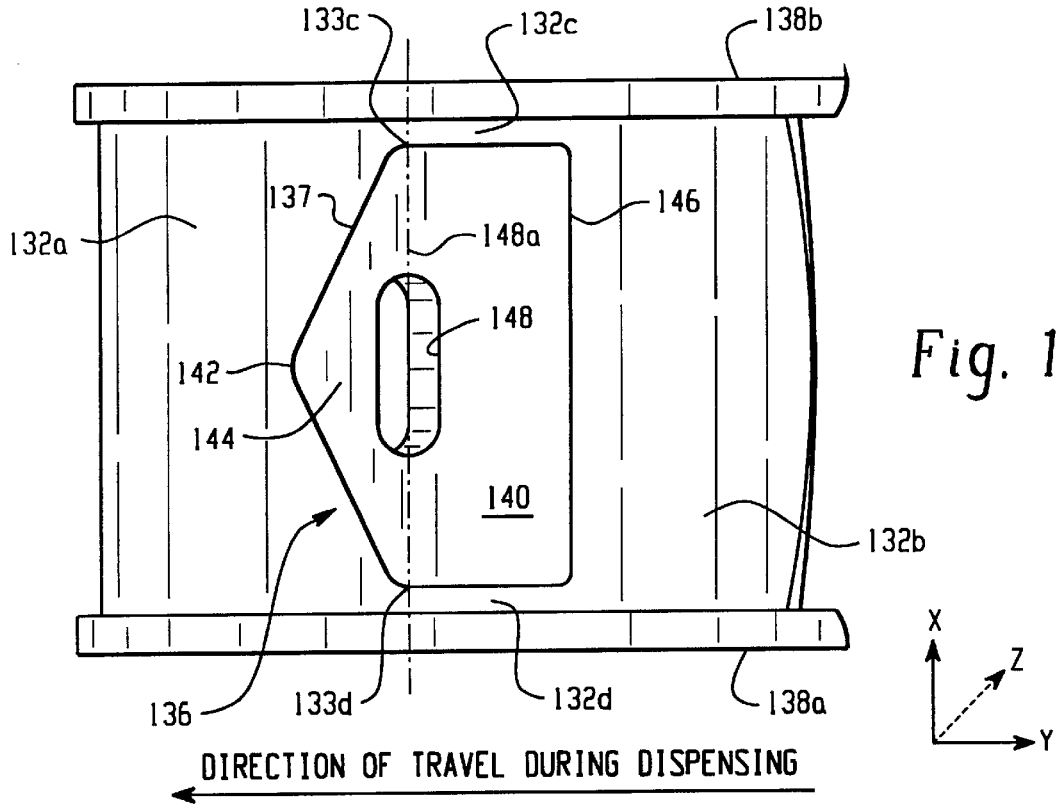
FIG. 11 is a bottom plan view of the rub block of FIG. 9.

As best illustrated in FIGS. 10 and 11, the positioning walls 134 taper to near flush or tangent with the felt supporting surface 132 in the vicinity of a galley or recess 136 formed in the supporting surface 132. The tangential taper of the walls 134 assure that only felt contacts the receiving surface S. By this arrangement, at the region of contact between the felt 26 and the receiving surface S, the galley 136 is behind the felt portion 26 and provides a volume in which pressurized liquid material flows from the nozzle orifice 112 through the felt. The galley 136 is recessed in the felt supporting surface 132 and extends across much of the surface 132 between the lateral sides 138*a* and 138*b* of the rub block 100. Note that for some liquids, particularly low viscosity liquids, the pressure of the liquid dispensed and soaked into the felt portion 26 may be very low.

The galley 136 is defined by a recessed inner wall 140. It is important to note that FIG. 10 illustrates the rub block in an upright position parallel to the Z axis. During a dispensing operation in the dual head configuration, the dispensing head 14 and hence the rub blocks 100 are tilted from vertical about 10° or so (see FIGS. 3A and 3B). Accordingly, in the embodiment of FIGS. 9–11, the galley 136 is positioned off center from the Z-axis by about 10°. The degree of off center location will be preferably matched to the degree of tilt applied to the dispensing section 14 by the robotic arm during a dispensing operation. Accordingly, the recessed inner wall 140 forms an angle $\alpha$ of about 10° to horizontal but is generally parallel to the receiving surface S when the dispensing head 14 is tilted during a dispensing operation. The depth of the galley 136 tapers somewhat along the Y axis since it is formed into a curved surface.

As best illustrated in FIG. 11, the galley 136 is bounded on one side by the adjacent web supporting surface portion 132*a,* on an opposite side by an adjacent web supporting surface portion 132*b,* and on opposite lateral sides by fairly narrow alleys 132*c* and 132*d*. Thus, the felt web 26 is fully supported along all edges of the galley 136, particularly when held under tension by the gripper pads 58 (FIG. 4). But at the region of contact between the felt 26 and the receiving surface S, a puddle or pressurized volume of liquid material is present and soaks through the felt 26 for application to the receiving surface. We have found that the use of such recessed galley 136 helps provide a more uniform and desired bead pattern applied to the receiving surface S.

The galley 136 is formed to an apex 142 at the leading end 137 of the galley 136. By leading end 137 is simply meant as the end of the galley that is towards the direction of travel as the dispensing head 14 is moved across the receiving surface S. Note that this leading apex 142 also corresponds to the deepest region 144 of the galley 136.

The aforementioned galley 136 geometry appears to allow more liquid material to be dispensed from the forward end 137 and less from the trailing end 146 of the galley 136 to produce a more consistent bead pattern, as the trailing portion of the felt web 26 may be less saturated and better able to smooth out the bead.

A through port 148 connects the galley 136 in fluid communication with a generally hemispherical cavity 150 formed in the rub block 100. The port 148 is preferably angled and positioned such that the major axis 148*a* of the port 148 opens to the galley 136 so as to be collinear with the forward ends 133*c* and 133*d* of the rectangular portion of the galley 136 that is further defined by the lateral sides 132*c*, 132*d* and the back or trailing end 146. The port 148 preferably opens to the cavity 150 at the bottom thereof. As best shown in FIG. 11, the port 148 preferably is oval shaped and oriented with its major axis 148*a* transverse to the direction of travel along the Y axis. This geometry of the port 148 opening to the galley 136 appears to help produce a consistent bead pattern.

The hemispherical cavity 150 is appropriately sized to receive somewhat more than half of the nozzle ball 106 (FIG. 8). A seal groove 152 is formed adjacent the cavity 150 and retains a suitable seal such as an o-ring 154. FIG. 8 illustrates the rub block 100 installed on the nozzle 102.

The rub block 100 is installed by inserting the nozzle ball 106 through a bore 156 formed in the block body 130, past the seal 154 and into the cavity 150. The seal 154 is sized to have an inner diameter that is somewhat smaller than the outside diameter of the ball 106 so that the block 100 is snapped onto the ball 106 and loosely retained on the ball by the seal 154. The seal 154 not only retains the rub block on the nozzle ball 106, but also will help prevent liquid material from flowing around the nozzle ball 106 due to back pressure.

The cavity 150 is sized somewhat larger than the nozzle ball 106 diameter. This assures that the rub block can easily pivot much like a ball and socket arrangement. The port 148 is appropriately dimensional so that the valve outlet orifice 112 is always open directly to the port 148 regardless of the pivoted position of the rub block 100.

Figure 12:
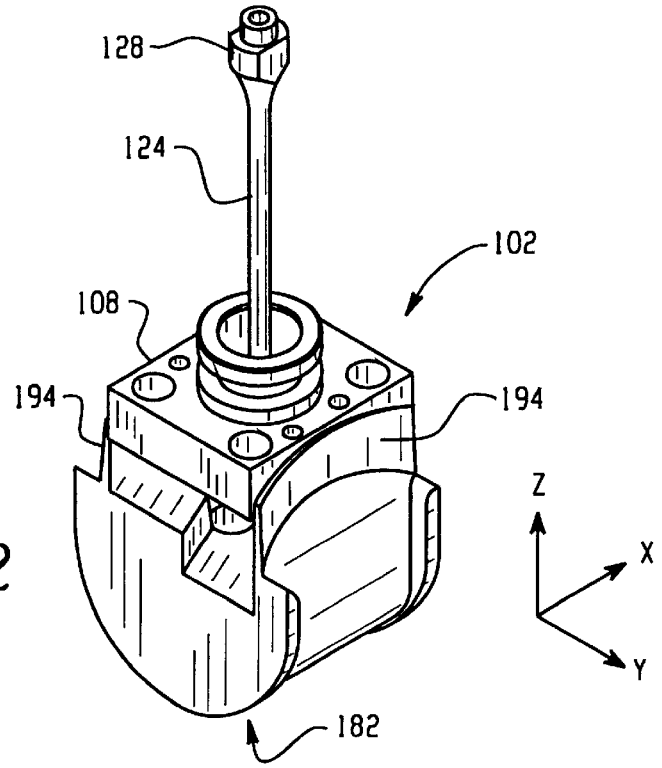
FIG. 12 is a perspective of a nozzle and rub block assembly showing a rub block used for a single dispensing head system.

With reference to FIGS. 9 and 10, the rub block 100 further includes parallel extending extensions, flaps or ears 160 which extend from respective ends of the felt web supporting surface 132. These ears 160 engage opposite sides of the nozzle block 108. The extensions 160 will therefore restrict pivoting or rotation of the rub block 100 about the Z and X axes (yaw and pitch respectively) but permit free pivoting movement about the Y axis (roll). FIG. 12 illustrates another rub block 182 installed on a nozzle 102. This rub block 182 is somewhat modified as will be described hereinafter, but nonetheless includes similar ears 194 that are positioned adjacent the nozzle mounting block 108 and restrict pivoting motion of the rub block 182 except about the Y axis.

FIGS. 9 and 10 illustrate that the leading side 162 of the rub block 100 is generally planar and flat compared to the trailing side 164. This arrangement permits closer positioning of the side by side dispensing heads 14*a* and 14*b* while allowing the felt web 12 to be wrapped around and supported by a curved surface (see FIG. 4).

Figure 13B:
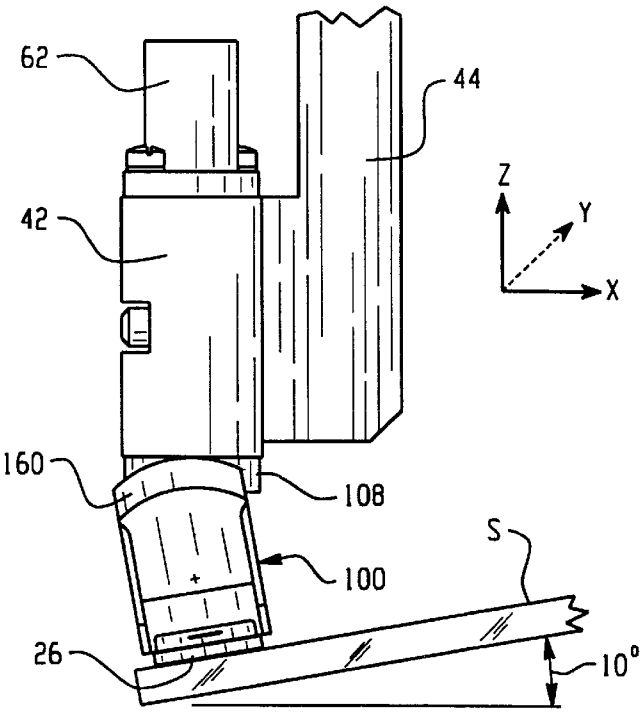
FIGS. 13A and 13B schematically illustrate operation of an articulated rub block.
Figure 13A:
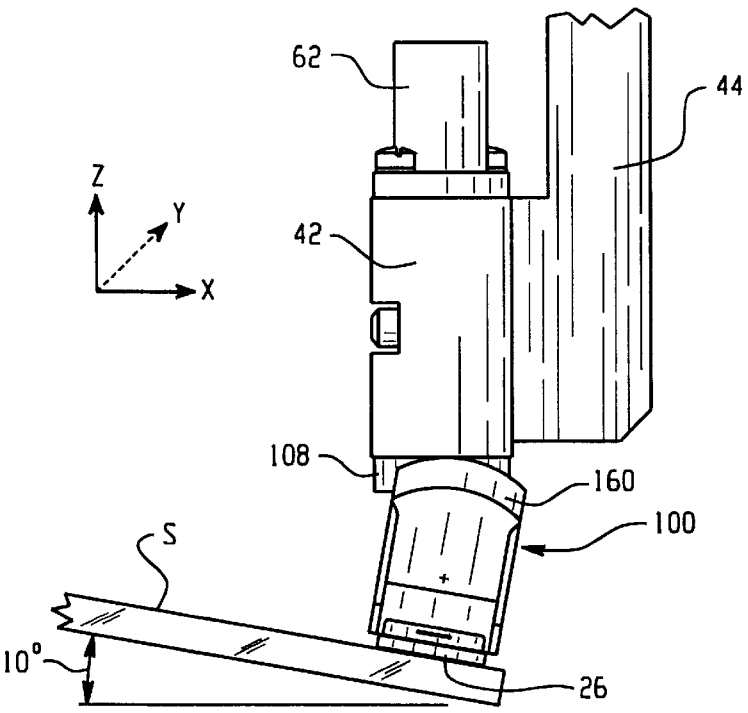

FIGS. 13A and 13B illustrate graphically how the articulated rub block 100 design improves application of liquid material to the receiving surface S. Note that in these figures the path of travel or Y axis is into the plane of the drawing. The robotic arm R generally maintains the dispensing guns 42 in a vertical orientation. However, when the receiving surface S is not horizontal, the rub block 100 can pivot about the Y axis thus maintaining excellent contact between the felt portion 26 and the receiving surface S. Variations in angle relative to the X axis are compensated for by the movement adjustment of the slider so along the Z axis (FIG. 4). The rub block 100 easily articulates due to its ball and socket type coupling to the ball nozzle 102 without adversely affecting flow of liquid material from the nozzle orifice 112 to the felt portion 26.

Figure 14B:
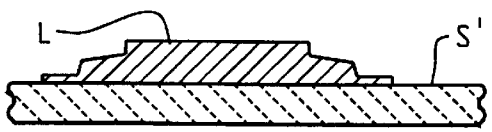
FIG. 14A illustrates a typical bead profile produced by prior art apparatus and FIG. 14B illustrates a typical bead profile achieved by the present invention.
Figure 14A:
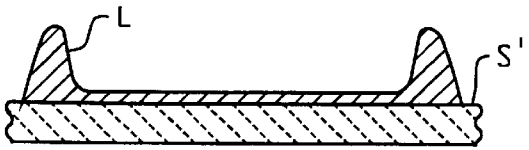
Fig. 14A PRIOR ART

FIG. 14A illustrates a typical bead profile of liquid material L applied to a receiving surface S' such as a windshield using a prior art process such as drip and drag. This profile is characterized by a "railroad track" effect wherein the bead has a small thickness in the center but raised edges on either side. By way of contrast, FIG. 14B illustrates a typical bead profile achieved by the present invention. The profile is characterized by a thicker middle or center section 1 and a tapering thickness portion 2 on either side to relatively thin edge portions 3. This profile is desirable for improving adhesion of the urethane to the windshield and more even distribution of the UV blocking layer under the urethane.

Figure 15:
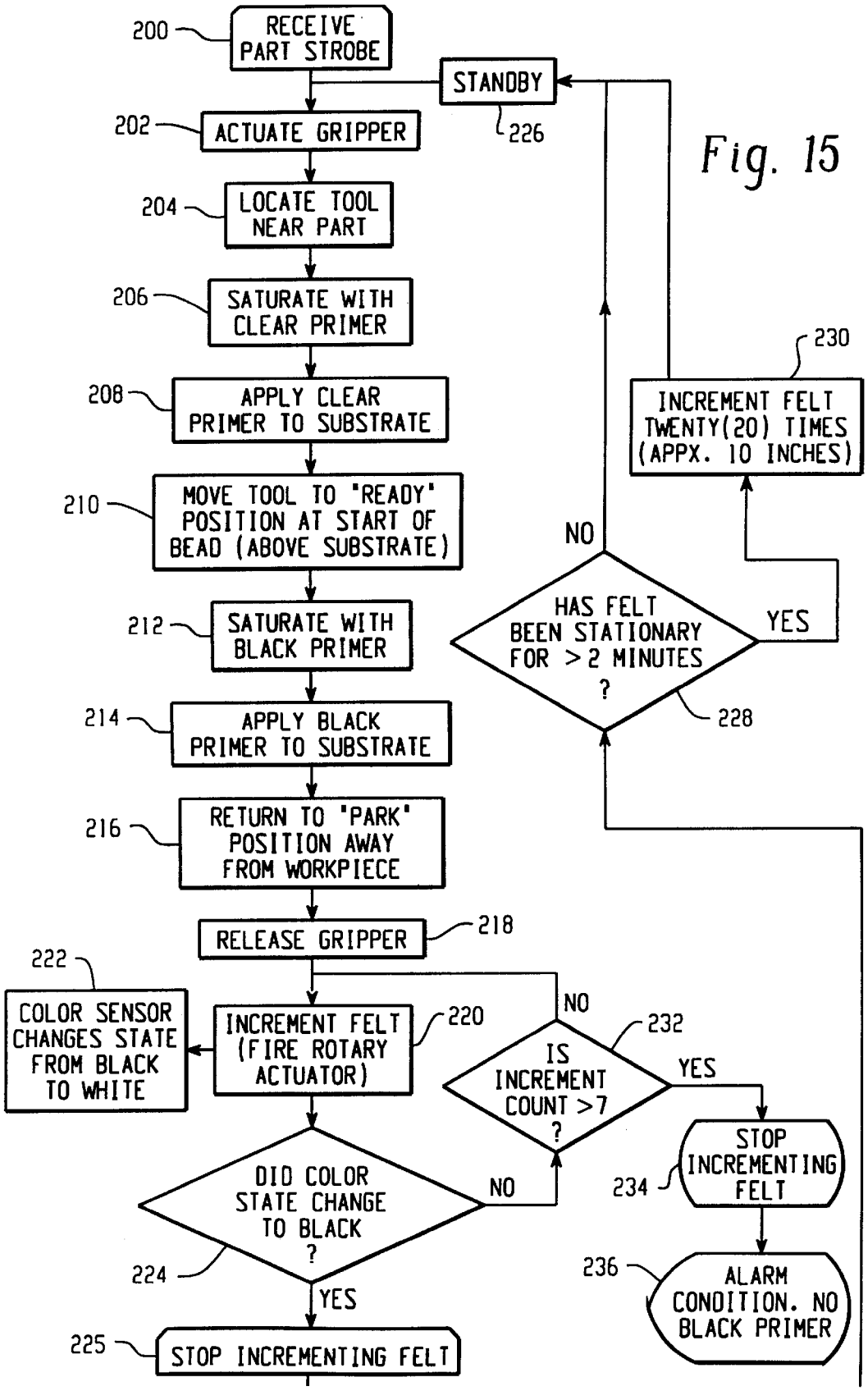
FIG. 15 is a flowchart for a control process for the dispensing apparatus of FIG. 1.

FIG. 15 illustrates a typical control process for a control system suitable for use with the present invention. This control process may be realized using conventional computer programming techniques well known to those skilled in the art.

At step 200 a sensor detects that a part such as a windshield has been presented to the dispensing apparatus. At step 202 the gripper jaws 56 are actuated to clamp the felt web 26 in position. The apparatus 10 (tool) is positioned by the robotic arm R near the receiving surface S at step 204. The needle valve within the nozzle 102 for the clear primer is opened and the associated felt portion is saturated with the clear primer at step 206. The robotic arm R pivots the dispensing head section 14 and at step 208 the clear primer is applied to the receiving surface S.

After the clear primer is completed, the apparatus 10 is moved to the "ready" position at the start of the bead at step 210 and the black primer needle valve is opened at step 212 to saturate the felt with black primer. At step 214 the robotic arm pivots the dispensing head section 14 in the opposite direction to apply black primer to the receiving surface S. The robotic arm R applies the black primer by traversing the receiving surface S on the opposite direction.

At step 216 the apparatus 10 is returned to a park position away from the part and the gripper jaws are released at step 218. The payout roller 32 rotates to index or advance the felt web 12 at step 220. This will cause a blackened portion of the felt to be sensed by the optical sensor 38 at step 222. If black is detected at step 224, the felt is stopped at 225 and the system goes into standby mode at step 226. But prior to standby mode, the system checks at step 228 if the felt has been stationary for more that a prescribed time such as longer than two minutes for example. If not, standby mode is entered.

If the time period exceeds the limit, the felt is advanced a greater distance at step 230. This it to prevent wet primer saturated felt from drying to the rolling and stationary elements over which it travels.

If at step 224 the black material is not detected, the system increments up to another seven times at step 232 to detect the type change. If after seven increments no change is detected, the felt is stopped at step 234 and an alarm indication at step 236 generated at step 236 to indicate probable depletion of the black primer liquid or a malfunction with the black primer dispensing head.

D. Additional Embodiments

Figure 16:
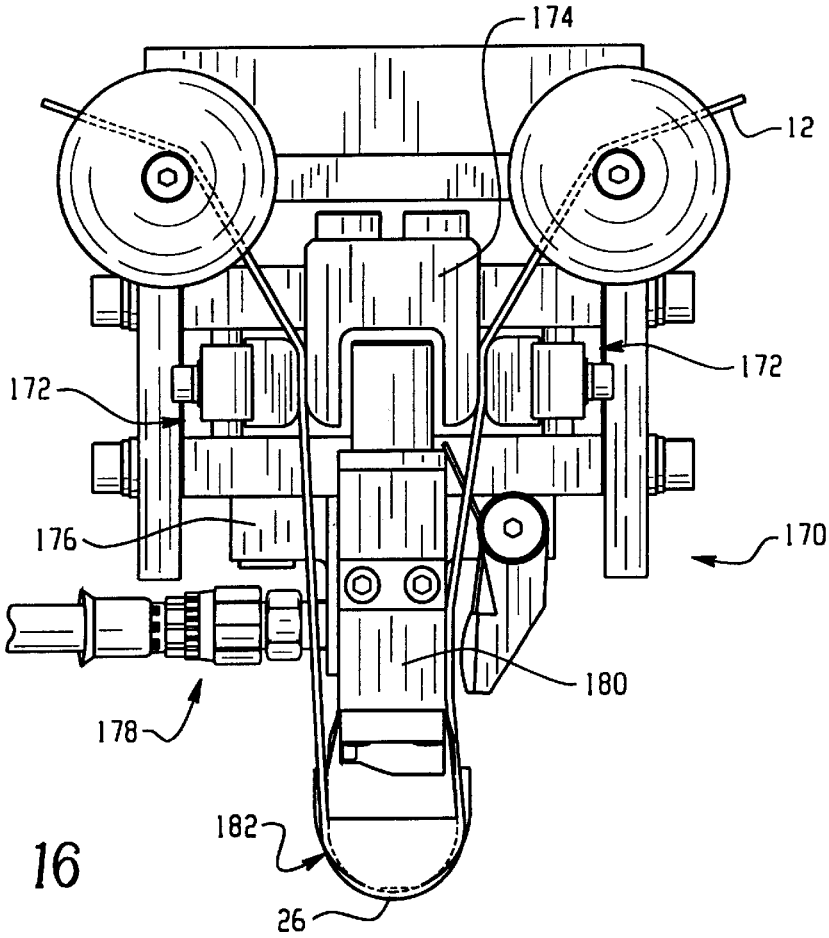
FIG. 16 is an elevation of a single dispensing head embodiment.

With reference to FIG. 16, the invention may also be realized in the form of a single dispensing head arrangement 170. Most of the features such as the gripper jaws 172, pinch block 174, manifold 176 and liquid inlet fitting 178 may be the same as the corresponding elements in the dual dispensing head, embodiment described hereinabove. The liquid dispensing gun 180 may also be the same except that only one is used along with a single rub block 182. FIG. 12 illustrates the rub block 182 and nozzle 102 in perspective.

Figure 17:
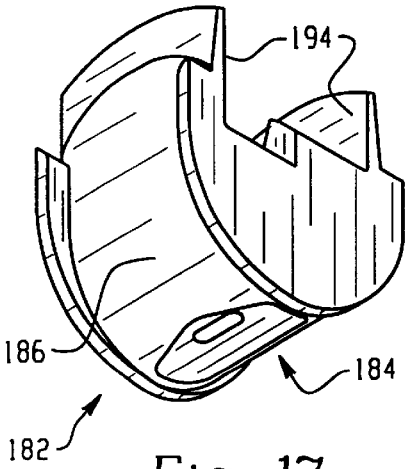
FIG. 17 is a below angle perspective of an alternative rub block embodiment for a single dispensing load application.
Figure 18:
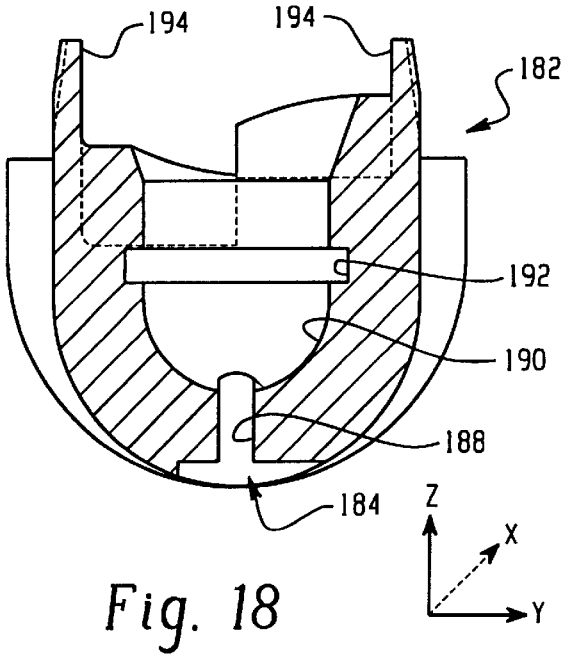
FIG. 18 is a longitudinal cross-section of the rub block of FIG. 17.

FIGS. 17 and 18 illustrate the rub block 182 design that may be used in a single gun application. In this example, the rub block 182 is generally symmetrical and the galley 184 is formed in the curved felt support surface 186 at the bottom of the block 182. Because only a single gun is used, there is no need to tilt or pivot the dispensing apparatus 10, but rather the gun 180 and the rub block 182 are vertically oriented on the Z axis. The galley 184 may be of similar design to the prior described embodiment herein, but the galley 184 is not offset by about 10° since the apparatus will not be tilted during a dispensing operation. A port 188 connects the galley 184 to a hemispherical cavity 190 and the rub block 182 is installed on the nozzle in a similar manner to the prior embodiment herein and retained by a seal (not shown) in a seal groove 192. The rub block 182 includes the ear extensions 194 to limit pivot movement about the Z and X axes (yaw and pitch) while permitting the rub block 182 to pivot or articulate about the Y axis (roll). Note that the rub block 182 support surface 186 is symmetrical about the Z axis because the felt web 12 will be supported along the curved surface on both sides of the block 182, in contrast to the dual head embodiment herein.

Figure 19A:
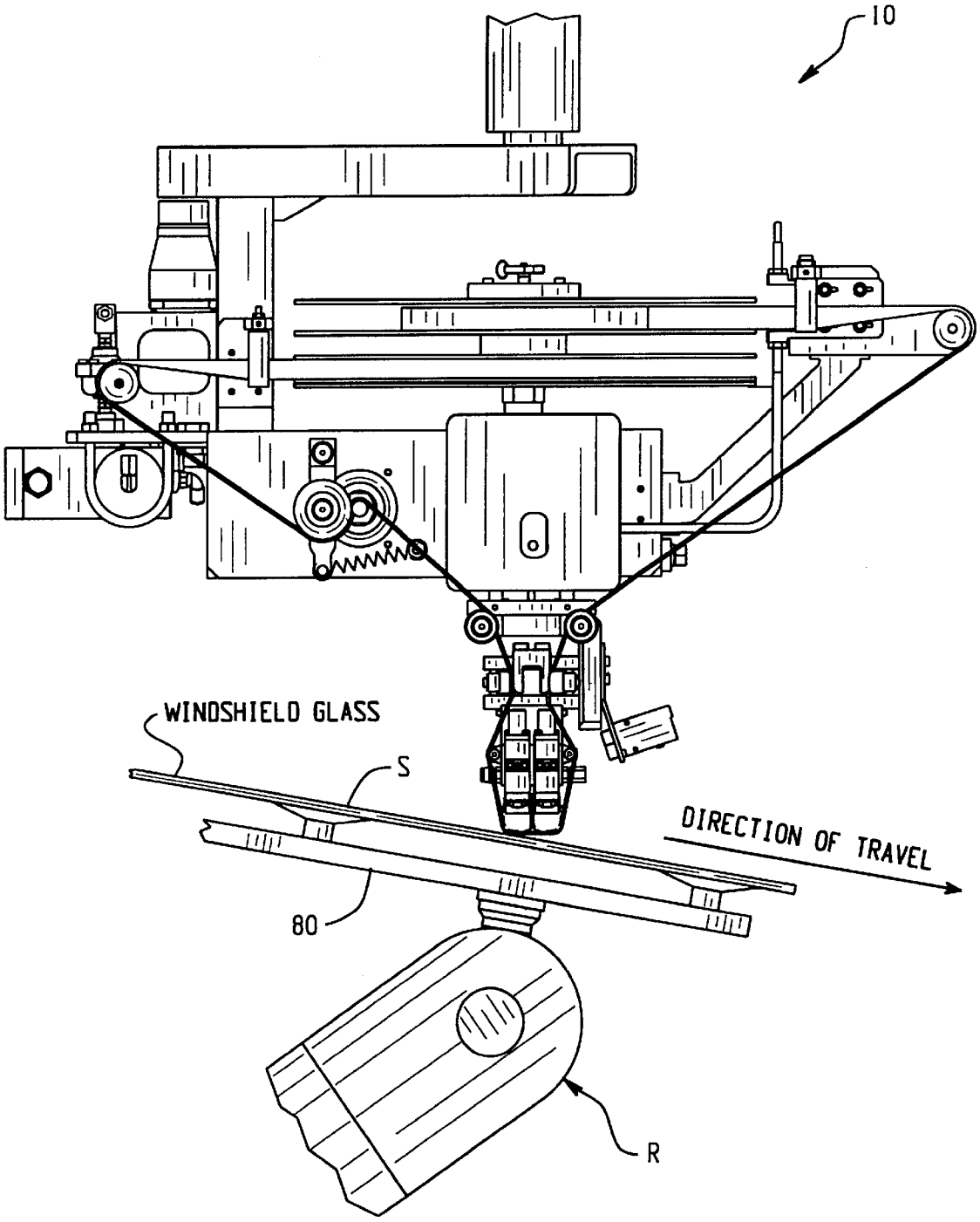
FIGS. 19A and 19B illustrate another embodiment of the invention.
Figure 19B:
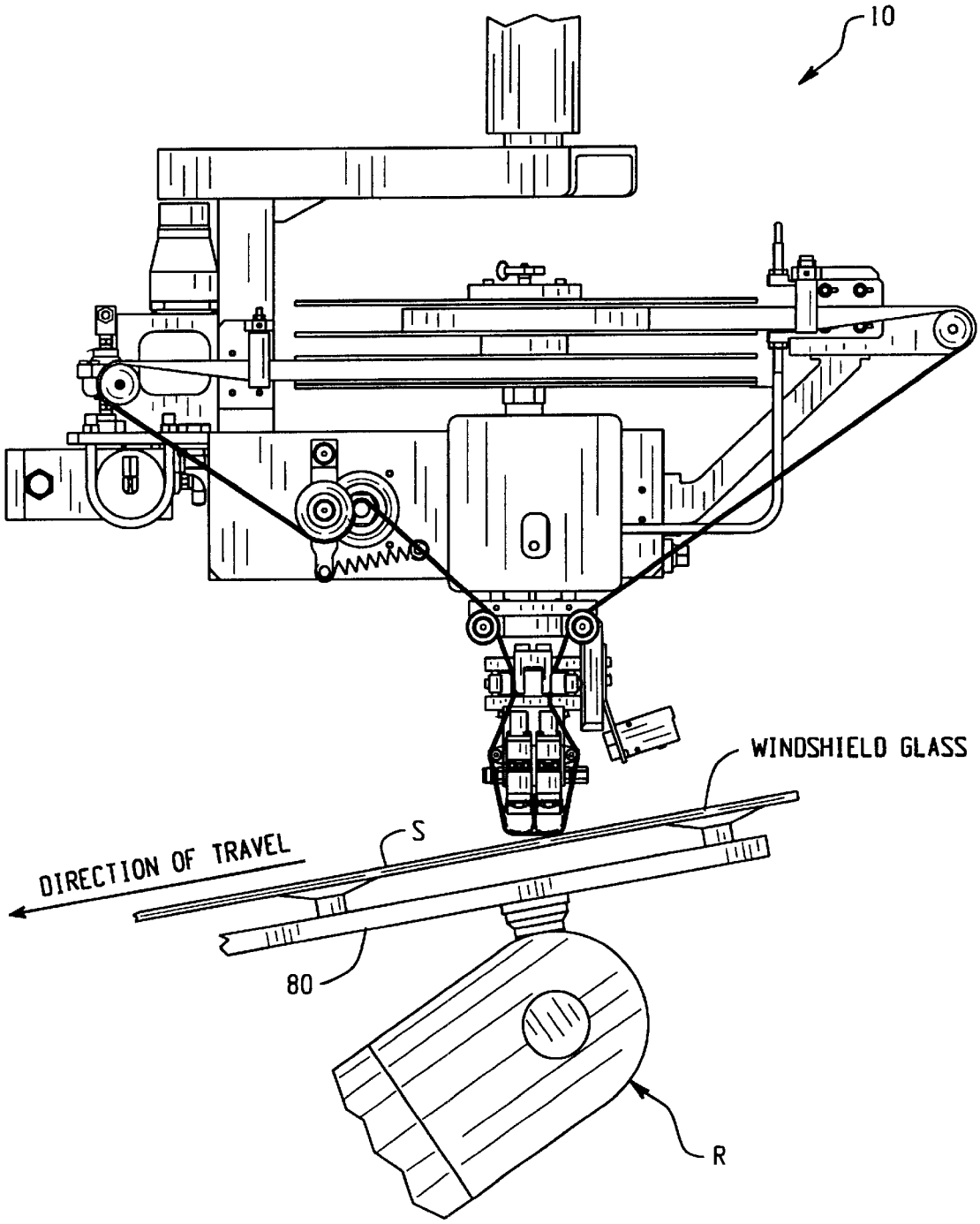

With reference to FIGS. 19A and 19B, the invention may be realized in the form of having the dispensing apparatus 10 remain stationary during a dispensing operation. In such an example, the workpiece, such as a windshield having the receiving surface S thereon, is mounted on a platform 80 that is attached to the robotic arm R. The robotic arm R tilts the workpiece to the appropriate angle such as about 10 degrees and moves the workpiece so as to apply the desired bead. Again, for application of the second type primer, the workpiece is tilted in the opposite direction and the direction of travel is reversed. Operation in all other respects is the same.

It should further be noted that the dual dispensing head aspect may be utilized in a dispensing apparatus that is not tilted and without the use of the articulated rub blocks. Such an embodiment is less preferred in that the rub blocks are not as compliant to the receiving surface, however, some of the benefits of the dual dispensing head arrangement are still realized.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

Having thus described the invention, we claim:

1. Fluid dispensing apparatus for applying a liquid material to a substrate, comprising:

at least two liquid dispensing nozzles each disposed within a respective nozzle block;

a web of material that is porous for liquid material dispensed from each said nozzle; said porous material being disposed between each said nozzle block and the substrate;

each said nozzle being operable to dispense liquid material onto the substrate by contact between said porous material and the substrate wherein each said nozzle block can pivot about a first axis.

2. The apparatus of claim 1 wherein each said nozzle block comprises a surface that supports said porous material against the substrate wit pressure being applied to said porous material when said porous material is in contact with the substrate during a dispensing operation.

3. The apparatus of claim 2 wherein each said block is compliant with variations in the substrate by pivoting movement with respect to at least one axis.

4. The apparatus of claim 3 wherein each said block is restricted against pivoting movement with respect to two axes that are each orthogonal to said at least one axis.

5. The apparatus of claim 2 comprising a channel formed in said surface and that is in fluid communication with a respective nozzle so that when liquid material is dispensed from said nozzle liquid material collects in said channel and is absorbed through said porous material onto the substrate.

6. The apparatus of claim 5 wherein liquid material is dispensed through said porous material under pressure.

7. The apparatus of claim 1 wherein each nozzle block can be individually positioned against the substrate to dispense liquid material thereon through said porous material.

8. The apparatus of claim 7 wherein said dispensing nozzles are mounted on a frame, and comprising a device for moving said frame to present each said nozzle and associated nozzle block against the substrate for dispensing liquid material thereon.

9. The apparatus of claim 8 wherein said device comprises a robotic arm and the substrate comprises a glass plate.

10. The apparatus of claim 9 wherein said glass plate comprises a motor vehicle windshield.

11. The apparatus of claim 7 wherein said device imparts relative motion between said nozzles and to substrate.

12. The apparatus of claim 1 wherein said porous material comprises a web of felt.

13. The apparatus of claim 1 comprising a flow regulator for controlling quantity of liquid material dispensed from said nozzles.

14. The apparatus of claim 1 comprising a supply mechanism for providing an unused portion of said porous material to each said nozzle block prior to a dispensing operation.

15. The apparatus of claim 14 wherein said supply mechanism comprises a continuous web of said porous material fed from a supply reel and received by a take-up reel.

16. The apparatus of claim 15 wherein said supply mechanism is configured so that each said nozzle dispenses liquid material onto the substrate prior to said supply mechanism feeding an unused portion of said porous material to each said nozzle block.

17. The apparatus of claim 1 wherein each said nozzle comprises a ball member that is received within said respective nozzle block.

18. The apparatus of claim 17 wherein each said nozzle block comprises a resilient member that slides over said bail when said ball is installed in said block to retain said block on said ball.

19. The apparatus of claim 18 wherein said resilient member comprises an -o-ring and seals against back flow of the liquid material.

20. Fluid dispensing apparatus for applying a liquid material to a substrate, comprising:

at least one liquid dispensing nozzle disposed within a rub block;

a web of material disposed against said rub block and that is porous to liquid material dispensed from said nozzle;

said porous material being supported on said rub block;

said nozzle being operable to dispense liquid material onto a surface of the substrate by contact between said porous material and the substrate with liquid material flowing through said porous material to said substrate;

wherein said rub block can pivot relative to said nozzle about a first axis in response to variations in the substrate surface.

21. The apparatus of claim 20 wherein said rub block and nozzle form a ball and socket coupling.

22. The apparatus of claim 20 wherein said nozzle includes a spherical nozzle body and said nab block includes a partially spherical cavity that receives said nozzle body.

23. The apparatus of claim 22 wherein said rub block is retained on said nozzle body by an elastomeric seal.

24. The apparatus of claim 20 wherein said nozzle is mounted to a frame that is translated across the surface of the substrate by relative movement therebetween to apply a bead of liquid material to a perimeter portion of the substrate.

25. The apparatus of claim 20 wherein said rub block is restricted against pivoting about two other axes normal to said first axis.

26. A dispensing head for a liquid dispensing gun, comprising:

a nozzle having a main body with an outlet orifice fanned therein; and a rub block mountable on said nozzle main body for relative pivoting movement with respect to each other.

27. The assembly of claim 26 wherein said rub block and nozzle main body are coupled together as a ball and socket arrangement.

28. The assembly of claim 26 wherein said rub block comprises a surface that supports a porous material and has a recess in said surface adjacent said porous material; said recess being in fluid communication with said nozzle outlet orifice.

29. The assembly of claim 26 wherein said outlet orifice is open and closed by a needle valve.

30. The assembly of claim 26 wherein said rub block pivots about a first axis and is restricted against pivoting about second and third axes that are normal to said first axis.

31. Fluid dispensing apparatus for applying a liquid material to a substrate, comprising:

at least two liquid dispensing nozzles each disposed within a respective rub block;

a web of material that is porous for liquid material dispensed from each said nozzle; said porous material being disposed between each said rub block and the substrate;

each said nozzle being operable to dispense liquid material onto the substrate by contact between said porous material and the substrate;

each said nib block being selectively and separately positioned for contacting said porous material with the substrate.

32. The apparatus of claim 31 comprising a frame; said nozzles and associated it blocks being disposed on said frame, and a mechanism for positioning said frame to first and second frame positions, wherein when said frame is in said first frame position a first of said rub blocks presses said porous material against the substrate and when said frame is in said second frame position a second of said rub blocks presses said porous material against the substrate.

33. Fluid dispensing apparatus for applying a liquid material to a substrate, comprising:

at least two liquid dispensing nozzles each disposed within a respective nozzle a web of material that is porous for liquid material dispensed from each said nozzle; said porous material being disposed between each said nozzle block and the substrate;

each said nozzle being operable to dispense liquid material onto the substrate by contact between said porous material and the substrate;

wherein each nozzle block can be individually positioned against the substrate to dispense liquid material thereon through said porous material.

* * * * *